US008876666B1

(12) United States Patent
Palmer et al.

(10) Patent No.: US 8,876,666 B1
(45) Date of Patent: Nov. 4, 2014

(54) EXERCISING ASSEMBLY

(76) Inventors: Brent M. Palmer, Sioux Falls, SD (US); Bradley M. Jones, Sioux Falls, SD (US)

( * ) Notice: Subject to any disclaimer, the term of this patent is extended or adjusted under 35 U.S.C. 154(b) by 336 days.

(21) Appl. No.: 13/424,888

(22) Filed: Mar. 20, 2012

(51) Int. Cl.
*A63B 21/04* (2006.01)

(52) U.S. Cl.
USPC ..... 482/41; 482/42; 482/120

(58) Field of Classification Search
USPC ..... 482/41, 42, 51, 54, 120–123
See application file for complete search history.

(56) References Cited

U.S. PATENT DOCUMENTS

| | | | | |
|---|---|---|---|---|
| 3,068,001 | A * | 12/1962 | Portman | 482/91 |
| 3,697,066 | A * | 10/1972 | Wieland et al. | 482/42 |
| 4,863,163 | A * | 9/1989 | Wehrell | 482/123 |
| 6,280,361 | B1 | 8/2001 | Harvey et al. | |
| 7,217,228 | B2 * | 5/2007 | Marquez | 482/130 |
| 7,410,450 | B1 | 8/2008 | Paulding | |
| 7,431,681 | B1 * | 10/2008 | St. Cyr | 482/121 |
| 7,608,025 | B1 | 10/2009 | Best | |
| 7,896,786 | B1 | 3/2011 | Osbourne | |
| 7,942,793 | B2 | 5/2011 | Mills et al. | |
| 2004/0009845 | A1 * | 1/2004 | Johnson | 482/41 |
| 2006/0122044 | A1 | 6/2006 | Ho | |
| 2006/0135329 | A1 | 6/2006 | Owen | |
| 2006/0194680 | A1 | 8/2006 | Croft | |
| 2007/0037678 | A1 | 2/2007 | Schaefer et al. | |
| 2008/0207405 | A1 * | 8/2008 | Jung | 482/38 |
| 2010/0167886 | A1 * | 7/2010 | Ko | 482/123 |
| 2011/0251033 | A1 | 10/2011 | Blancher | |

* cited by examiner

*Primary Examiner* — Glenn Richman

(57) ABSTRACT

An exercising assembly includes a support that is configured to support a person over a floor a surface. The support includes a platform having an upper surface, a lower surface and a perimeter edge extending between the upper and lower surfaces. A plurality of apertures extends through the platform and a frame abuts the lower surface. A plurality of legs is attached to and extends downwardly from the frame. A plurality of resiliently stretchable tethers each has a first end and a second end, each of the first ends is attached to the support and is positioned beneath the lower surface, each of the tethers extending into one of the apertures such that each of the second ends is positioned above the lower surface. Each of the second ends comprises a mating member configured to be releasably coupled to or gripped by a person.

17 Claims, 9 Drawing Sheets

EXERCISING ASSEMBLY

BACKGROUND OF THE DISCLOSURE

Field of the Disclosure

The disclosure relates to exercising devices and more particularly pertains to a new exercising device for providing resistance bands to a person from below the person such that the resistance bands do not interfere with but instead enhance movement of the person.

SUMMARY OF THE DISCLOSURE

An embodiment of the disclosure meets the needs presented above by generally comprising a support that is configured to support a person over a floor a surface. The support includes a platform having an upper surface, a lower surface and a perimeter edge extending between the upper and lower surfaces. The platform includes a first edge, a second edge, a third edge and a fourth edge wherein the first and second edges are positioned opposite of each other. A plurality of apertures extends through the platform and a frame abuts the lower surface. A plurality of legs is attached to and extends downwardly from the frame. A plurality of resiliently stretchable tethers each has a first end and a second end, each of the first ends is attached to the support and is positioned beneath the lower surface, each of the tethers extends into one of the apertures such that each of the second ends is positioned above the lower surface. Each of the second ends comprises a mating member configured to be releasably coupled to or gripped by a person.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
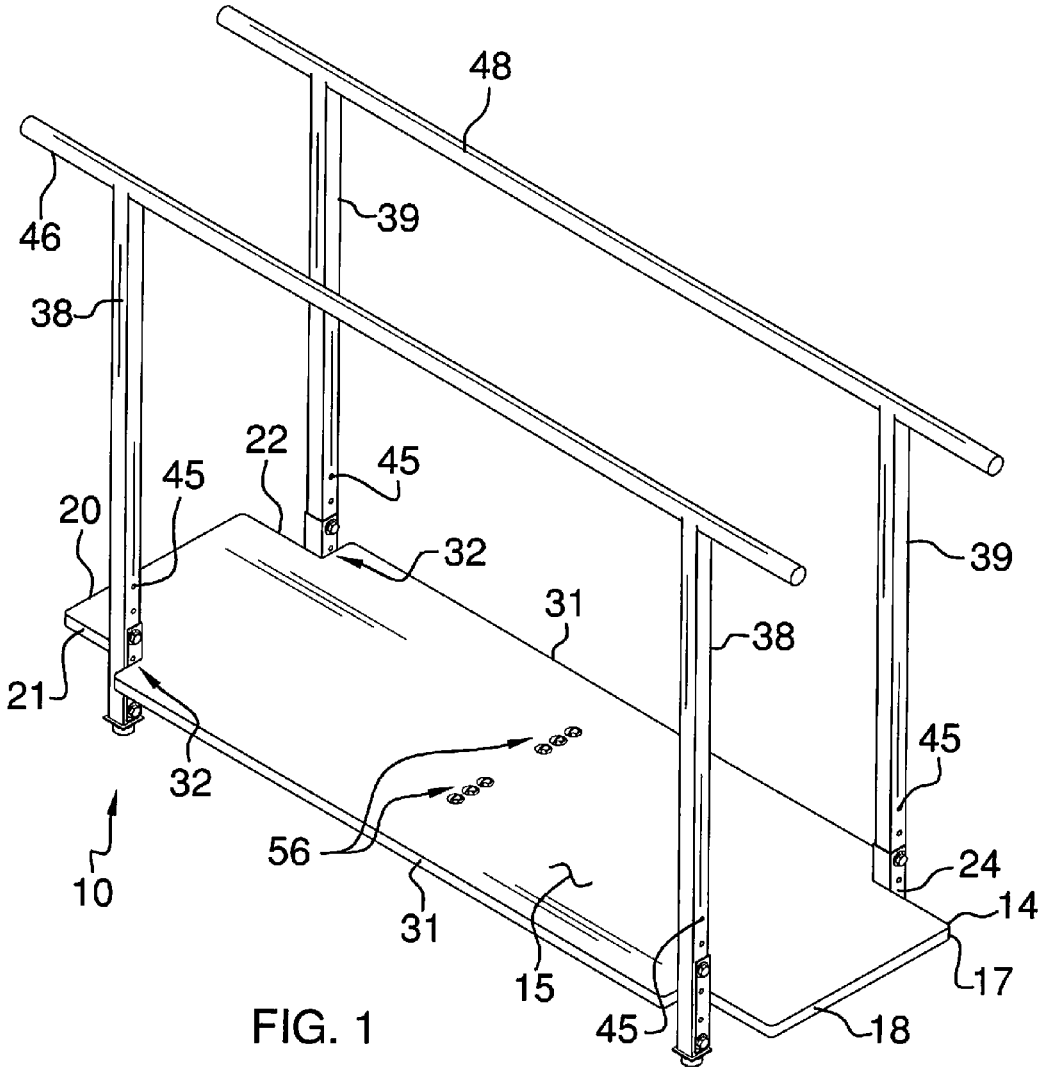
FIG. 1 is a top perspective view of an exercising assembly according to an embodiment of the disclosure.
Figure 2:
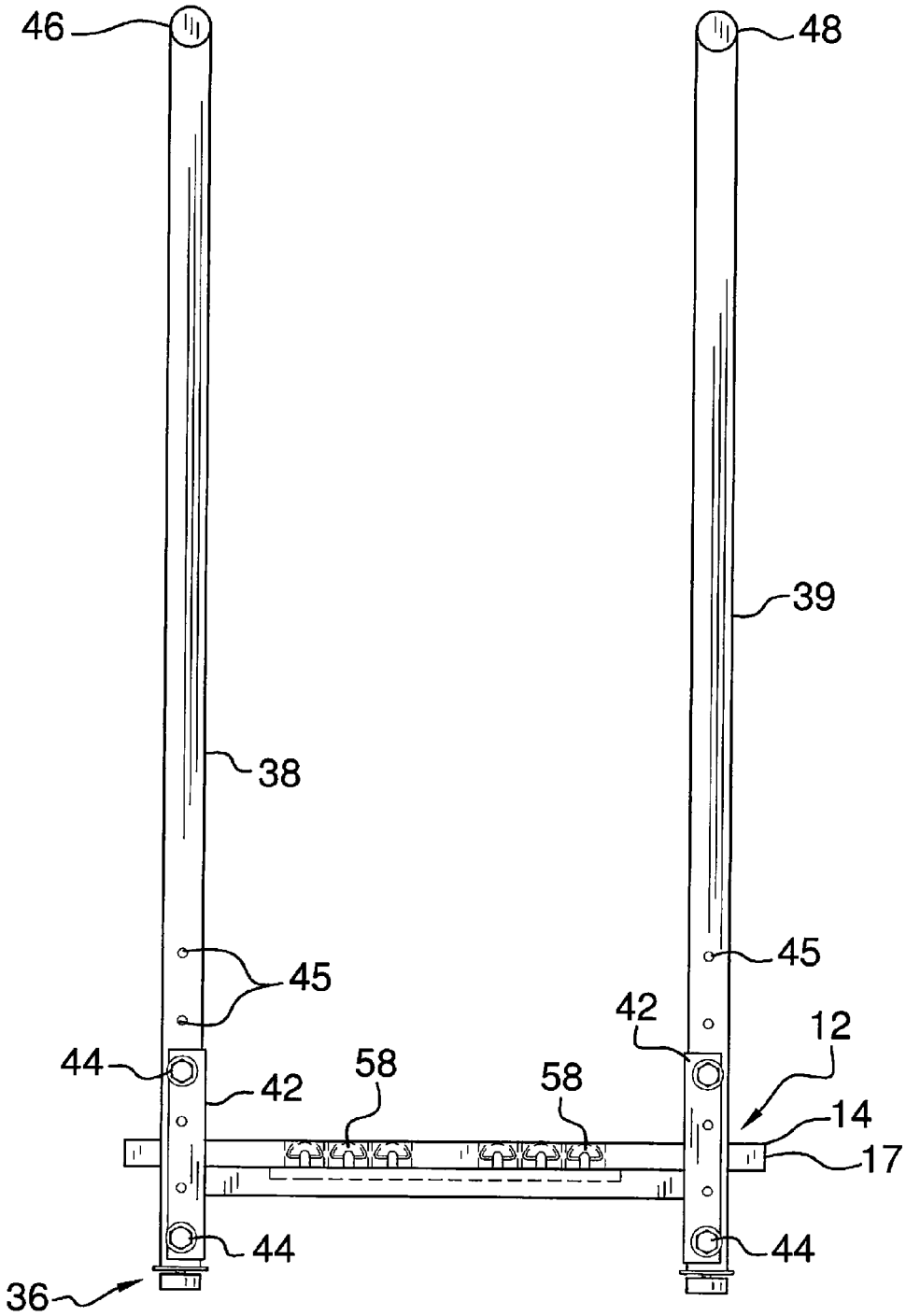
FIG. 2 is a right side view of an embodiment of the disclosure.
Figure 3:
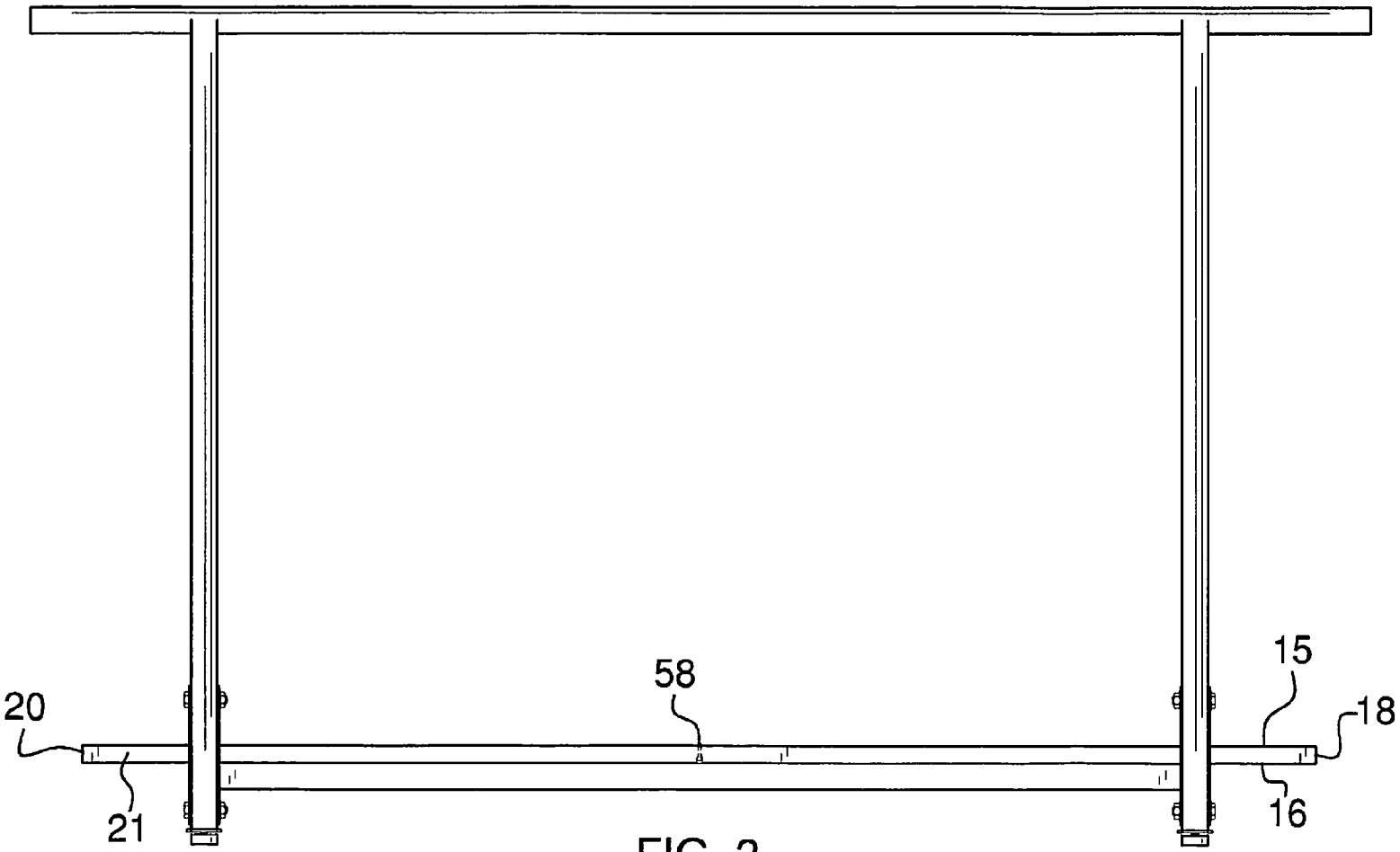
FIG. 3 is a front view of an embodiment of the disclosure.

With reference now to the drawings, and in particular to FIGS. 1 through 10 thereof, a new exercising device embodying the principles and concepts of an embodiment of the disclosure and generally designated by the reference numeral 10 will be described.

As best illustrated in FIGS. 1 through 10, the exercising assembly 10 generally comprises a support 12 that is configured to support a person over a floor a surface. The support 12 includes a platform 14 having an upper surface 15, a lower surface 16 and a perimeter edge 17 extending between the upper 15 and lower surfaces 16. The platform 14 includes a first edge 18, a second edge 20, a third edge 21 and a fourth edge 22 wherein the first 18 and second 20 edges are positioned opposite of each other. The platform 14 is elongated from the first edge 18 to the second edge 20 and may have a length from the first edge 18 to the second edge 20 between 4.0 feet and 10.0 feet and a width from the third edge 21 to the fourth edge 22 between 1.5 feet and 4.0 feet. The platform 14 is generally rigid and may be comprised of any conventional material such as for example wood, plastics and metal. Though not shown, the platform 14 may be comprised of two or more panel sections removably coupled to each other to allow the platform 14 to be collapsed such as during storage or transportation.

Figure 4:
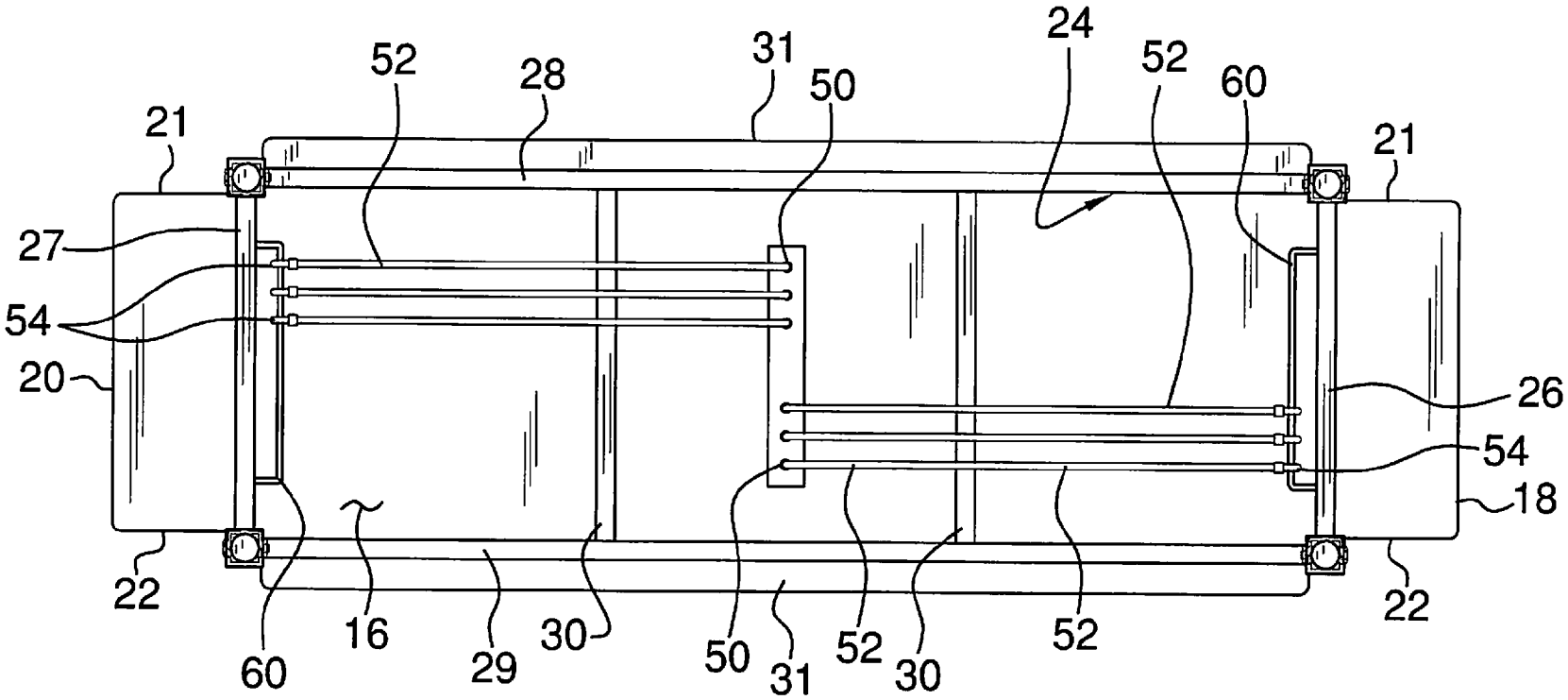
FIG. 4 is a bottom view of an embodiment of the disclosure.

The support 12 further includes a frame 24 abutting the lower surface 16. The frame 24 includes a first elongated member 26, a second elongated member 27, a third elongated member 28 and fourth elongated member 29 attached together in a rectangular configuration. Additional braces 30 may be attached to the frame 24 and traverse portions of the lower surface 16 such as between the third 28 and fourth 29 elongated members as shown in FIG. 4. The first elongated member 26 is positioned adjacent to the first end edge 18 and the second elongated member 27 is positioned adjacent to the second end edge 20. The platform 14 may include a pair of flanges 31. Each of the third 21 and fourth 22 edges has one of the flanges 31 attached thereto and extending away therefrom such that the flanges 31 are each coplanar with the platform 14. One of the flanges 31 extends over and abuts the third elongated member 28 and another one of the flanges 31 extends over and abuts the fourth elongated member 29. Together, the flanges 30, 31 and the third 21 and fourth 22 edges form notches 32 where they join for reasons discussed below.

Figure 5:
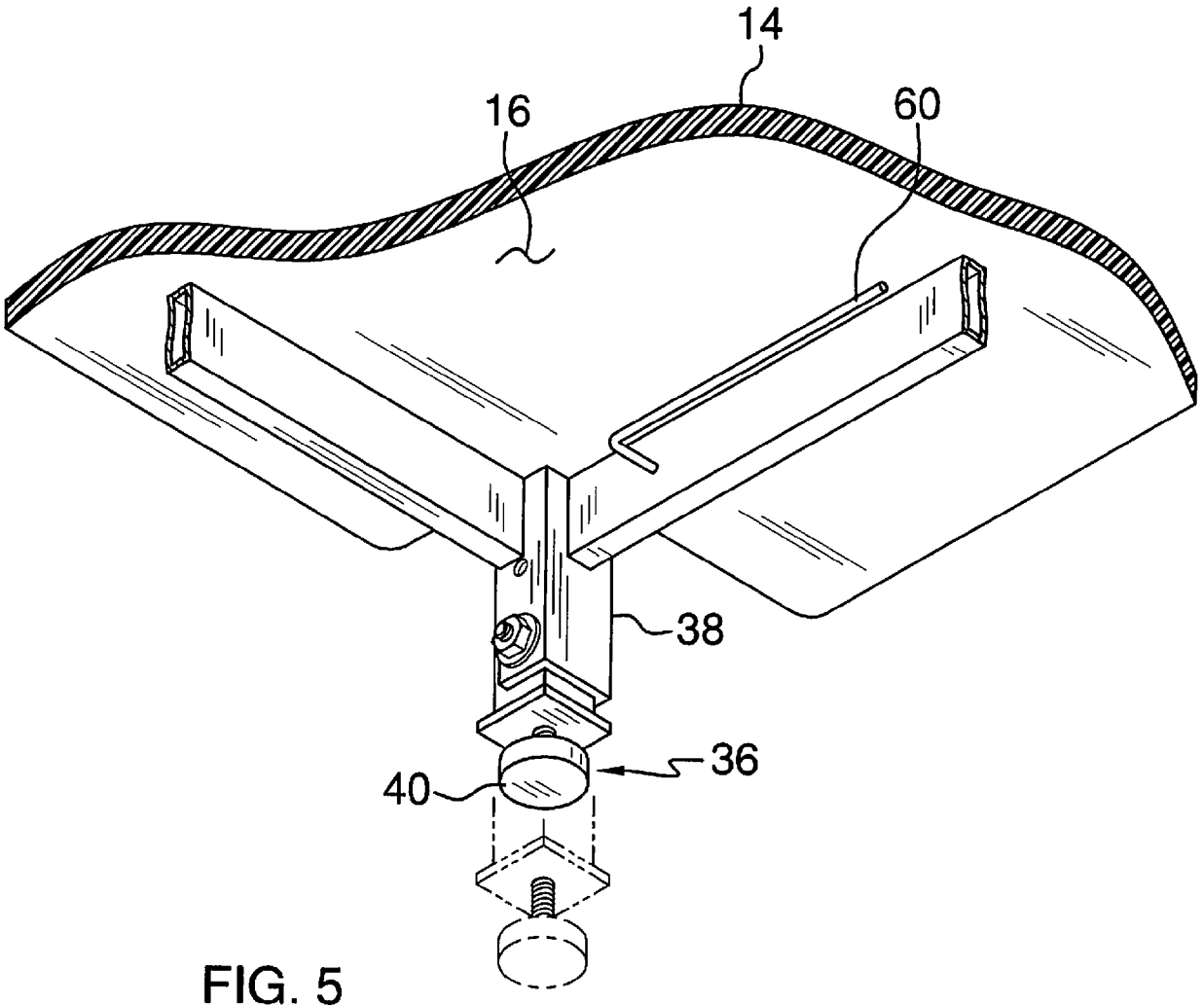
FIG. 5 is a bottom perspective view of a leg of an embodiment of the disclosure.
Figure 6:
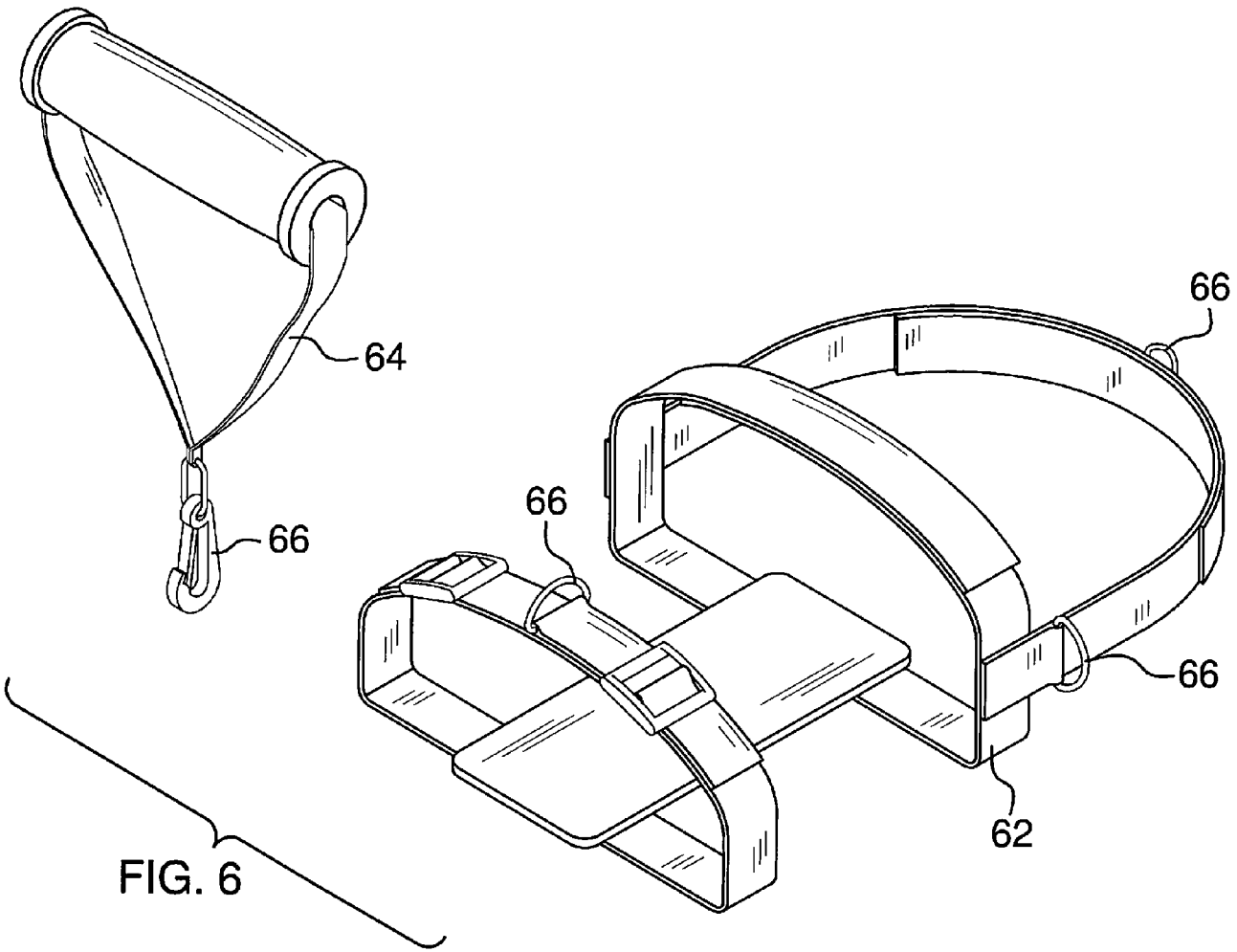
FIG. 6 is a top perspective view of an embodiment of the disclosure.

A plurality of legs 36 is attached to and extends downwardly from the frame 24 and a plurality of posts 38, 39 is attached to and extends upwardly from the frame 24. Though the Figures show each of the legs 36 and posts 38, 39 may to be formed together such that each post 38, 39 also forms a leg 36, it should be understood that the legs 36 and posts 38, 39 need not be formed together. As can be seen in FIG. 5, each of the legs 36 may include a foot member 40 threadably coupled to a corresponding post 38, 39 to allow the legs 36 to be extended away from the frame 24 as needed. The posts 38, 39 may be attached to the frame 24 with brackets 42 including fasteners 44 extending into openings 45 in the posts 38, 39. The posts 38, 39 may include a vertical column of openings 45 to allow the brackets 42 to be positioned where needed to raise the platform 14 relative to an upper end of the posts 38, 39. Alternatively, the posts 38, 39 may be telescopic to allow their height to be selectively adjusted.

A first pair of the posts 38 is positioned adjacent to the third edge 21 and a second pair of the posts 39 is positioned adjacent to the fourth edge 22. As can be seen in the Figures, if the flanges 31 are present, the notches 32 will receive the posts 38, 39 to prevent the movement of the platform 14 on the frame 24. This will allow the platform 14 to remain unattached to the frame 24, though it should be understood that the platform 14 may be coupled to the frame by conventional means such as fasteners, adhesives and the like. Furthermore, it should be understood that that platform 14 and frame 24 may be constructed of a single construction being non-removable and integrally joined together.

Figure 7:
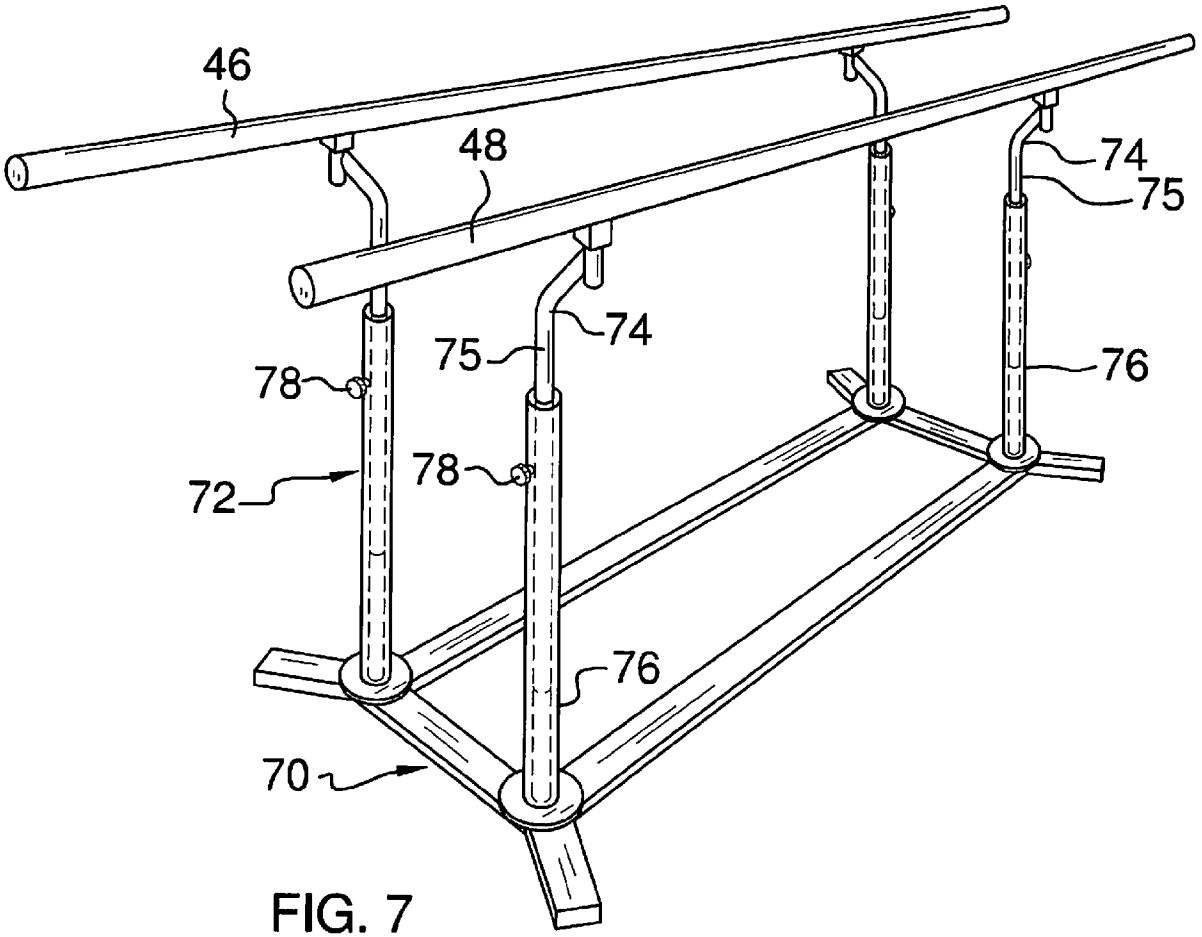
FIG. 7 is a top perspective view of an embodiment of a frame of the disclosure.
Figure 8:
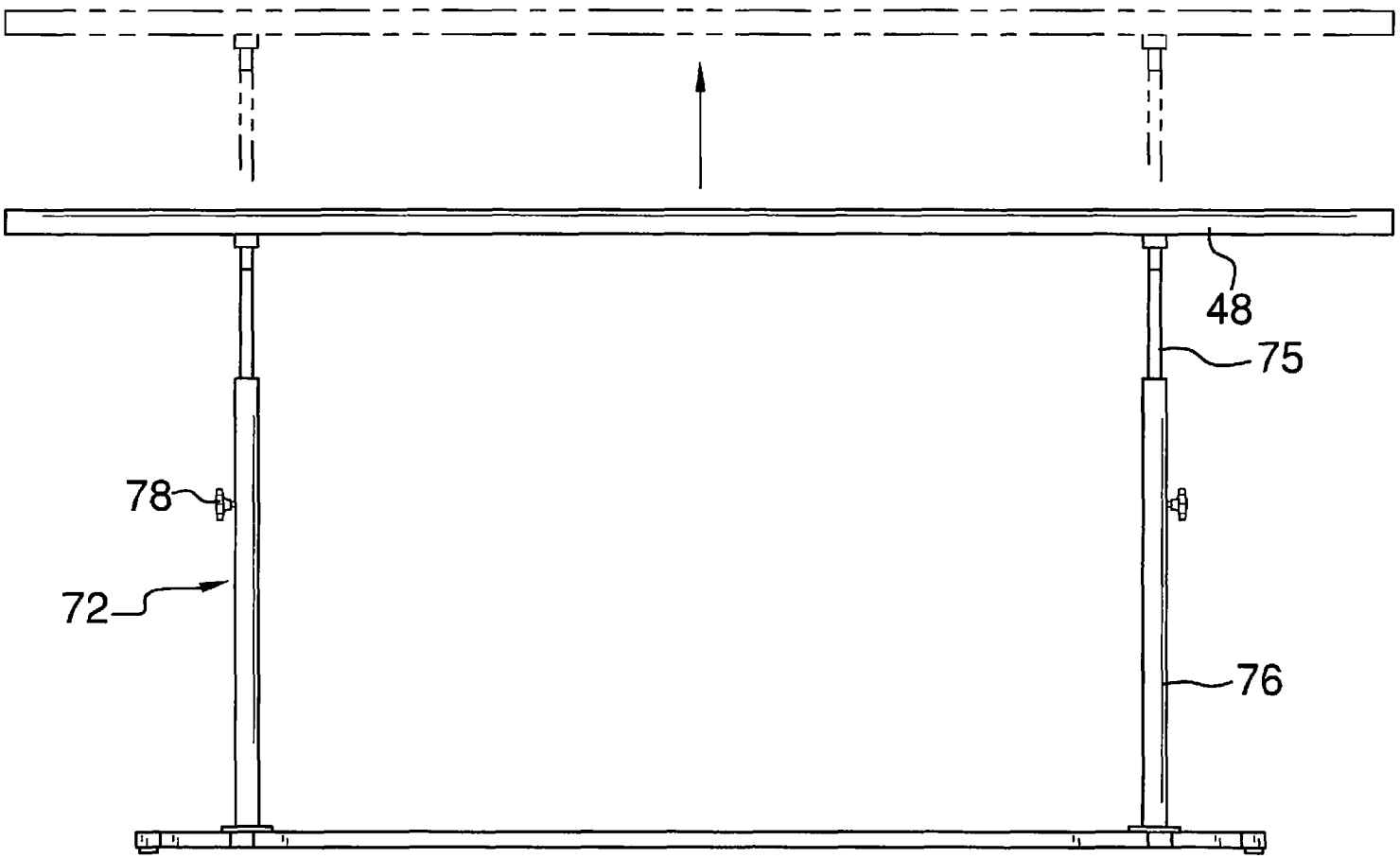
FIG. 8 is a side view of an embodiment of a frame of the disclosure.

A first hand grip 46 is attached to and extends between the posts of the first pair of posts 38 and a second hand grip 48 is attached to and extends between the posts of the second pair of posts 39. The first 46 and second 48 hand grips each is elongated and orientated parallel to each other. A distance from the first 46 and second 48 hand grips to the upper surface 15 is between 3.0 feet and 5.0 feet. This height may be adjustable by movement of the brackets 42 relative to the first 46 and second 48 hand grips or if the assembly 10 is provided with telescopic posts. FIG. 7 shows an embodiment of the frame 70 wherein the posts 72 and legs are not formed of a single structure and that the legs 36 may be eliminated. More particular, FIG. 7 teaches posts 72 that are telescope and which may or may include bends 74 to provide a larger area of space between the first 46 and second 48 hand grips. The upper portions 75 of these posts 72 may be rotatable or removable from the lower portions 76 to also change the distance between the first 46 and second 48 hand grips to not only allow for different sized users but to also allow the user to selectively change the focus of resistance on the arms, back, shoulders and chest as would be understood to one in the fitness arts. A lock 78 may be used to secure the upper 75 and lower 76 portions at a selected height and rotation with respect to each other.

The platform 14 has a plurality of apertures 50 extending therethrough and in particular through the upper 15 and lower 16 surfaces. The apertures 50 are positioned in a central area of the platform and are spaced from the first 18 and second 20 edges. The apertures 50 may be aligned with each other along a line orientated perpendicular to a longitudinal axis of the platform 14 extending through the first 18 and second 20 edges. The apertures 50 may also be positioned between and spaced from the flanges 31. Typically, the plurality of apertures 50 includes at least four apertures though two apertures or more may be used and it may be beneficial to have at least six apertures 50 as shown in FIG. 4. Alternatively, a single aperture 50 may be used as long as it is sized to accommodate more than one tether 52 as described below. FIG. 1 shows a platform having six apertures 50 extending therethrough which may be beneficial for allowing a diversity of tethers 50 without overcrowding of the upper surface 15.

A plurality of resiliently stretchable tethers 52 is provided and each has a first end 54 and a second end 56. Each of the first ends 54 is attached to the support 12 and is positioned beneath the lower surface 16. This may be accomplished in any conventional manner such as by clips, hooks, tying and the like. Each of the tethers 52 extends into one of the apertures 50 such that each of the second ends 56 is positioned above the lower surface 16. The second ends 56 each comprises a mating member 58 configured to be releasably coupled to or gripped by a person. For instance, the mating member 58 may include a closed loop as shown in the Figures and in particular the mating member 58 may have a size to prevent it from being pulled through the apertures 50. Each of the tethers may comprise an elastomeric material such as is used for conventional exercise bands. The frame 24 may have one or more rods 60 attached thereto to provide quick attachment points for the first ends 54 of the tethers 52 to be attached. The tethers 50 may be provided in pairs of tethers 52 wherein each tether 50 of a pair has a same resistance but the pairs are of a different resistance rating with respect to each other to allow a user of the assembly to alter the resistance and hence the difficulty of a performed exercise. When a tether 52 becomes worn or simply of incorrect resistance, it can quickly be replaced by removing the first ends 54 from the frame 24. It should be understood that while one tether 52 per aperture 50 may be beneficial, if the apertures 50 are of sufficient size, a user may extend multiple ones of tethers 52 through each or selected ones of the apertures 50 to thereby increase the number of tethers 52 available for use.

Figure 9:
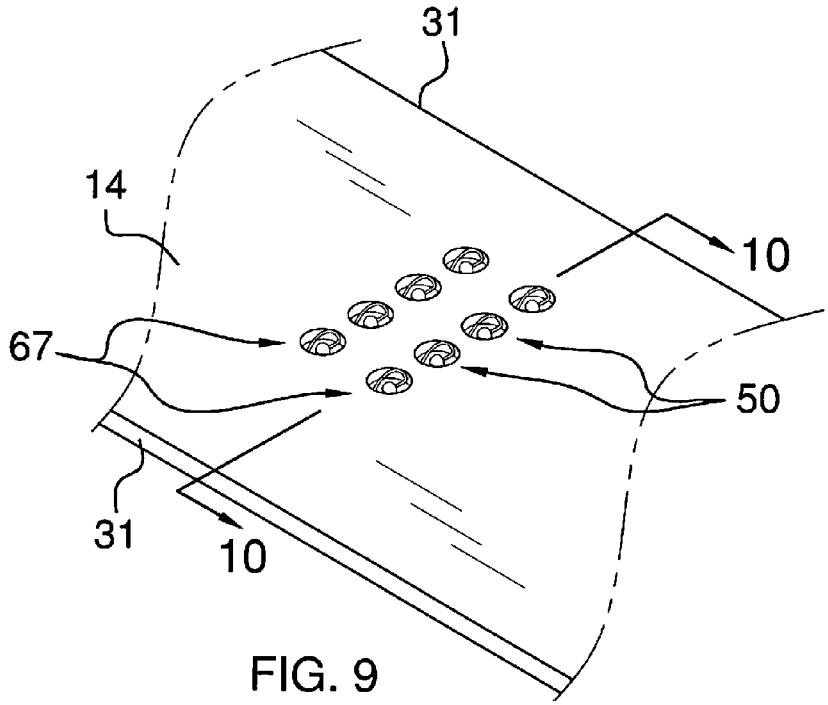
FIG. 9 is a top perspective view of an embodiment of a platform of the disclosure.
Figure 10:
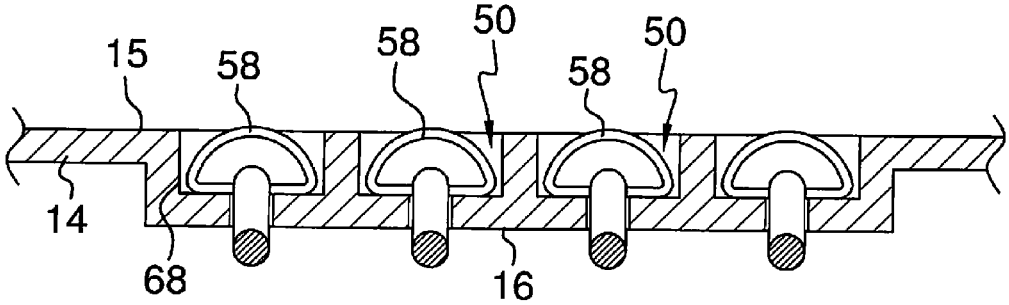
FIG. 10 is a cross-sectional view of an embodiment of the platform taken along line 10-10 of FIG. 9.

FIGS. 9 and 10 depict an embodiment wherein the apertures 50 are formed into a pair of rows 67 of apertures 50. The rows 67 may be spaced from each other between 1.0 inch and 5.0 inches. The rows 67 may each contain three or more apertures 50 and more particularly at least four apertures 50. The rows 67 are parallel with respect to each other and perpendicular to the longitudinal axis of the platform 14. The rows 67 will also be centrally located as indicated above. FIGS. 9 and 10 also depict a structure wherein the panel 14 further includes a reinforcing member 68 positioned below the apertures 50. The reinforcing member 68 allows for the panel 14 to remain relatively thin while allowing the mating members 58 to be at least partially countersunk into the panel 14 to prevent them from interfering with a user's feet. It should be understood that a lowermost surface of the reinforcing member 68 further defines the lower surface 16 of the panel such that the second ends 56 are positioned above the lower surface 16. The apertures 50 taper inwardly from the upper surface 15 to the lower surface 16 in FIG. 10 to allow the mating members 58 to fit below the upper surface 15 but remain too large to extend through the lower surface 16. The reinforcing member 68 may either be integrally coupled to the panel 14 such that it is non-removable and formed of a unitary piece of material with the panel 14 or attached to the panel.

In use, a user of the assembly 10 will typically place their self on the platform 14 and engage their legs, hands or both with one or more of the tethers 52. To facilitate this, the user may incorporate foot strap assemblies 62 or hand holds 64 including corresponding mating members 66 to engage the tether mating members 58. Once coupled to the tethers 52, the user may or may not also use the first 46 and second 48 hand grips either for balance or for enhancement of an exercise. For instance, a user may attach each of their feet to a different tether and lift their body off of the platform 14 while moving their legs to concurrently exercise the arms, legs and stomach muscles. Since the tethers 52 may be used in any direction relative to the platform 14, there is little impeding a person from using the tethers 52 for any exercise requiring resistance. Consequently, all areas of the body may be thoroughly exercised and these exercises may have difficulty and/or stability added to them with usage of the hand grips.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. An exercise assembly comprising:

a support being configured to support a person over a floor a surface, said support including;

a platform having an upper surface, a lower surface and a perimeter edge extending between said upper and lower surfaces, said platform including a first edge, a second edge, a third edge and a fourth edge wherein said first and second edges are positioned opposite of each other;

said platform having a plurality of apertures extending therethrough;

a frame abutting said lower surface, said platform being positioned on said frame;

a plurality of legs being attached to and extending downwardly from said frame; and a plurality of resiliently stretchable tethers each having a first end and a second end, each of said first ends being attached to said support and being positioned beneath said lower surface, each of said tethers extending through one of said apertures such that each of said second ends is positioned above said upper surface, each of said second ends comprising a mating member configured to be releasably coupled to or gripped by a person.

2. The exercise assembly according to claim 1, wherein said platform is elongated from said first edge to said second edge, said platform having a length from said first edge to said second edge between 4.0 feet and 10.0 feet, said platform having a width from said third edge to said fourth edge between 1.5 feet and 4.0 feet.

3. The exercise assembly according to claim 1, wherein said apertures are positioned in a central area of said platform and are spaced from said first and second edges.

4. The exercise assembly according to claim 3, wherein said apertures being aligned with each other along a line orientated perpendicular to a longitudinal axis of said platform extending through said first and second edges.

5. The exercise assembly according to claim 3, wherein said plurality of apertures includes at least four apertures.

6. The exercise assembly according to claim 1, wherein said frame includes a first elongated member, a second elongated member, a third elongated member and fourth elongated member attached together in a rectangular configuration, said first elongated member being positioned adjacent to said first end edge and said second elongated member being positioned adjacent to said second end edge.

7. The exercise assembly according to claim 1, wherein said frame further includes:

a plurality of posts being attached to and extending upwardly from said frame, a first pair of said posts being positioned adjacent to said third edge; and a first hand grip being attached to and extending between said posts of said first pair of posts.

8. The exercise assembly according to claim 7, wherein said frame further includes:

a second pair of said posts being positioned adjacent to said fourth edge; and a second hand grip being attached to and extending between said posts of said second pair of posts.

9. The exercise assembly according to claim 8, wherein said first and second hand grips each are elongated and orientated parallel to each other.

10. The exercise assembly according to claim 9, wherein a distance from said first and second hand grips to said upper surface is between 3.0 feet and 5.0 feet.

11. The exercise assembly according to claim 6, wherein said platform includes a pair of flanges, each of said third and fourth edges having one of said flanges attached thereto and extending away therefrom, each of said flanges being coplanar with said platform, one of said flanges extending over and abutting said third elongated member and another one of said flanges extending over and abutting said fourth elongated member.

12. The exercise assembly according to claim 11, wherein said apertures are positioned between and spaced from said flanges.

13. The exercise assembly according to claim 11, wherein said apertures are positioned in a central area of said platform and are spaced from said first and second edges.

14. The exercise assembly according to claim 13, wherein said apertures being aligned with each other along a line orientated perpendicular to a longitudinal axis of said platform extending through said first and second edges.

15. The exercise assembly according to claim 13, wherein said plurality of apertures includes at least four apertures.

16. The exercise assembly according to claim 1, said frame including at least one rod attached thereto, each of said first ends of said tethers being attached to said rod.

17. An exercise assembly comprising:

a support being configured to support a person over a floor a surface, said support including;

a platform having an upper surface, a lower surface and a perimeter edge extending between said upper and lower surfaces, said platform including a first edge, a second edge, a third edge and a fourth edge wherein said first and second edges are positioned opposite of each other, said platform being elongated from said first edge to said second edge, said platform having a length from said first edge to said second edge between 4.0 feet and 10.0 feet, said platform having a width from said third edge to said fourth edge between 1.5 feet and 4.0 feet;

said platform having a plurality of apertures extending therethrough, said apertures being positioned in a central area of said platform and being spaced from said first and second edges, said apertures being aligned with each other into one or more rows orientated perpendicular to a longitudinal axis of said platform extending through said first and second edges, said plurality of apertures including at least four apertures;

a frame abutting said lower surface, said frame including a first elongated member, a second elongated member, a third elongated member and fourth elongated member attached together in a rectangular configuration, said first elongated member being positioned adjacent to said first end edge and said second elongated member being positioned adjacent to said second end edge;

a plurality of legs being attached to and extending downwardly from said frame;

a plurality of posts being attached to and extending upwardly from said frame, a first pair of said posts being positioned adjacent to said third edge and a second pair of said posts being positioned adjacent to said fourth edge;

a first hand grip being attached to and extending between said posts of said first pair of posts;

a second hand grip being attached to and extending between said posts of said second pair of posts, said first and second hand grips each being elongated and orientated parallel to each other, a distance from said first and second hand grips to said upper surface being between 3.0 feet and 5.0 feet;

said platform including a pair of flanges, each of said third and fourth edges having one of said flanges attached thereto and extending away therefrom, each of said flanges being coplanar with said platform, one of said flanges extending over and abutting said third elongated member and another one of said flanges extending over and abutting said fourth elongated member, said apertures being positioned between and spaced from said flanges;

a plurality of resiliently stretchable tethers each having a first end and a second end, each of said first ends being attached to said support and being positioned beneath said lower surface, each of said tethers extending into one of said apertures such that each of said second ends is positioned above said lower surface, each of said second ends comprising a mating member configured to be releasably coupled to or gripped by a person, each of said tethers comprising an elastomeric material; and said frame including at least one rod attached thereto, each of said first ends of said tethers being attached to said rod.

* * * * *